US007654500B1

(12) United States Patent
Jump

(10) Patent No.: US 7,654,500 B1
(45) Date of Patent: Feb. 2, 2010

(54) WALL HANGING ADJUSTABLE MOUNT

(76) Inventor: Kevin Jump, 6750 White Pine Dr., Bloomfield Hills, MI (US) 48301

( * ) Notice: Subject to any disclaimer, the term of this patent is extended or adjusted under 35 U.S.C. 154(b) by 0 days.

(21) Appl. No.: 10/807,506

(22) Filed: Mar. 23, 2004

Related U.S. Application Data

(60) Provisional application No. 60/477,394, filed on Jun. 11, 2003, provisional application No. 60/534,158, filed on Jan. 2, 2004.

(51) Int. Cl.
*A47G 1/00* (2006.01)

(52) U.S. Cl. ..... 248/476; 248/495; 248/497

(58) Field of Classification Search ..... 248/475.1, 248/476, 477, 479, 489, 466, 495, 496, 497, 248/498; 40/747, 757; 411/398, 531, 533, 411/539, 272, 273, 238
See application file for complete search history.

(56) References Cited

U.S. PATENT DOCUMENTS 1,871,615 A * 8/1932 Jones ..... 248/470
2,384,478 A * 9/1945 Lapeyre ..... 248/497
2,771,259 A * 11/1956 Laystrom ..... 248/489
3,006,443 A * 10/1961 Siler ..... 403/408.1
3,063,669 A * 11/1962 Bell ..... 248/549
3,143,915 A * 8/1964 Tendler ..... 411/29
3,330,525 A 7/1967 Weinstein
3,529,799 A * 9/1970 Schaefer ..... 248/496
3,861,639 A * 1/1975 Morrill ..... 248/489
4,044,813 A * 8/1977 Emmons ..... 160/369
4,143,848 A * 3/1979 Slemmons ..... 248/489
4,232,496 A * 11/1980 Warkentin ..... 403/288
4,496,128 A 1/1985 Larsen
4,522,378 A * 6/1985 Nelson ..... 267/141.4
4,549,713 A 10/1985 Magadini
4,655,351 A * 4/1987 Walker ..... 211/88.01
5,069,411 A 12/1991 Murphy
6,527,244 B1 3/2003 Kamenstein et al.
6,572,067 B1 6/2003 Kamenstein et al.
6,663,075 B2 12/2003 Zuller

FOREIGN PATENT DOCUMENTS

GB 2241731 A * 9/1991

* cited by examiner

*Primary Examiner*—J. Allen Shriver, II
*Assistant Examiner*—Steven M Marsh
(74) *Attorney, Agent, or Firm*—Brooks Kushman P.C.

(57) ABSTRACT

An adjustable mounting and method for a wall hanging utilizes a disc mounting element secured to the wall with a threaded fastener passing through an eccentrically located hole. The disc is rotated to bring the top of a groove to a desired position and the fastener tightened to secure the disc in the adjusted position. The wall hanging has one or more supports which are engaged with the top of the disc perimeter. A peripheral groove engaging the support may be defined by continuous flared sides or two series of offset outwardly flared teeth. A stepped depth groove can better engage toothed supports.

11 Claims, 3 Drawing Sheets

WALL HANGING ADJUSTABLE MOUNT

CROSS REFERENCE TO RELATED APPLICATIONS

This application claims the benefit of U.S. provisional Ser. No. 60/477,394, filed Jun. 11, 2003, and U.S. provisional Ser. No. 60/534,158, filed Jan. 2, 2004.

BACKGROUND OF THE INVENTION

This invention concerns mounts for wall hangings such as framed pictures. Difficulties are often encountered with achieving a level mount where two supports are used, since the two supports must be at equal heights to level the wall hanging.

It also can be difficult to align a single supported wall hanging with other hangings in a grouping.

A wall hanging mount should also be useable with wire hung pictures and saw tooth supports.

These difficulties have long been recognized and various adjustable mounts proposed, but those have usually been costly, complex, difficult to use devices, which sometimes have not allowed an infinite height adjustment.

It is the object of the present invention to provide a simple, low cost mounting for wall hangings which also allows an infinite adjustment in height within a range of adjustment.

SUMMARY OF THE INVENTION

The above recited object and other objects which will be appreciated upon a reading of the following specification and claims are achieved by a mounting element having a engagement feature configured to engage a support on the wall hanging to be mounted. The element is secured on a wall with a threaded fastener such as a screw passed through the element at an eccentric location with respect to the engagement feature.

The mounting element is normally held tight against a wall surface by pressure developed when the fastener is tightened. With the fastener not fully tightened, the element is rotated about the eccentric axis of the fastener, causing the location of the perimeter engagement to shift vertically. After a desired adjustment is made, the fastener is fully tightened to secure the element in its adjusted position.

Protrusions on a back surface of the element may be provided which are pushed slightly into the wall surface to prevent slippage out of an adjusted position.

The mounting element may be of a generally circular disc shape. In a first embodiment, a groove around the perimeter of the element defined by outwardly flared sides comprises the engagement feature which can receive a wire used to support the wall hanging on the mounting element.

In a second embodiment, the mounting element comprises a disc having two sets of oppositely flared teeth arranged about its perimeter, the teeth in each set alternately located about the circumference. The opposite flaring of the sides of the teeth creates an intervening annular space the bottom which also comprises an engagement feature which can receive a support wire but also can be engaged by saw tooth features on conventional support pieces affixed to the wall hanging. The bottom of the annular space is stepped to secure the engagement with saw teeth, and also to enable a simple mold comprised of a cope and mold for injection molding of the element from plastic, eliminating the need for mold slides or actions.

The front face of the element is preferably counterbored on both sides about the eccentrically located hole through which the threaded fastener passes, on the front side to recess the fastener head, on the underside to accommodate any portion of the wall anchor that protrudes above the wall surface.

DETAILED DESCRIPTION

Figure 1:
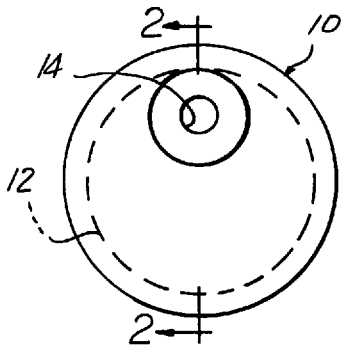
FIG. 1 is a front view of a first embodiment of a mounting element according to the present invention.
Figure 2:
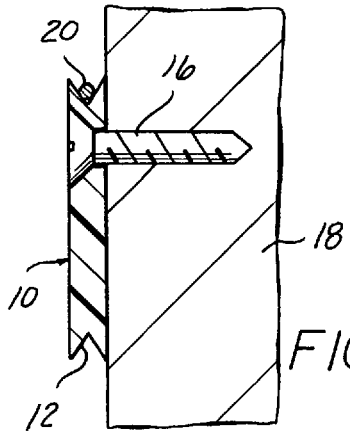
FIG. 2 is a view of the section 2-2 taken in FIG. 1, with screw and a wire seated in a perimeter groove.
Figure 10:
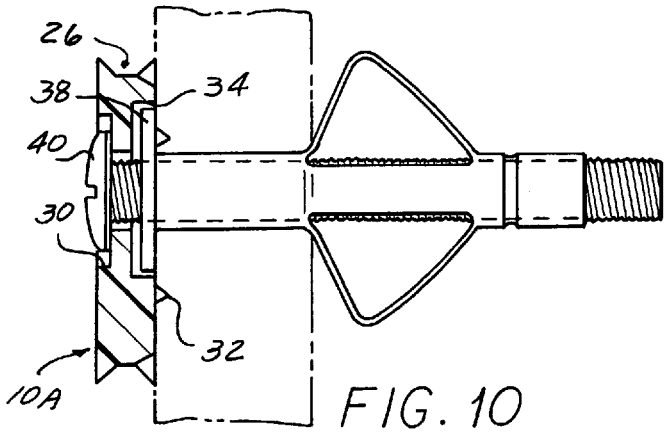
FIG. 10 is a view of the section 9 with the mounting element installed on a hollow wall.
Figure 3:
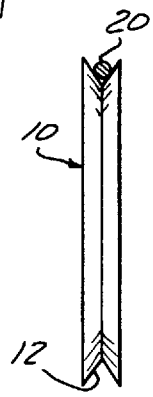
FIG. 3 is a side view of the element shown in FIG. 1.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims Referring to the drawings, and particularly FIGS. 1-4C, the present invention includes a mounting element 10, here comprised of a small disc (which could be molded from plastic or die cast from metal) having a peripheral V-groove 12 defined by outwardly flared sides.

A through axial hole 14 is formed therein at a location eccentric with respect to the center of the perimeter of the element 10. The hole 14 receives a threaded fastener 16 used to secure the element 10 to a wall 18. When the screw 16 is not tightened, the element 10 can be rotated about an axis defined by the fastener 16.

Figure 4A:
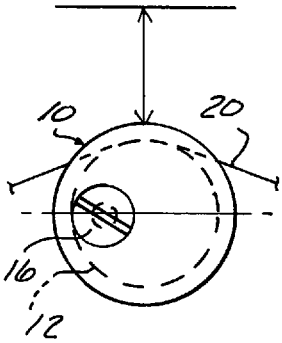
FIGS. 4A-4C are front views of the element shown in FIGS. 1-3 in respective adjusted positions.
Figure 4B:
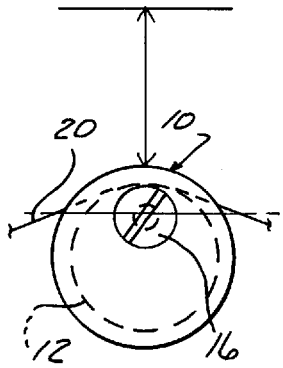
Figure 4C:
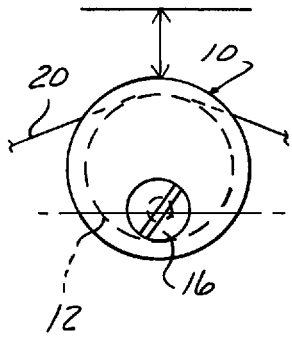
Figure 5:
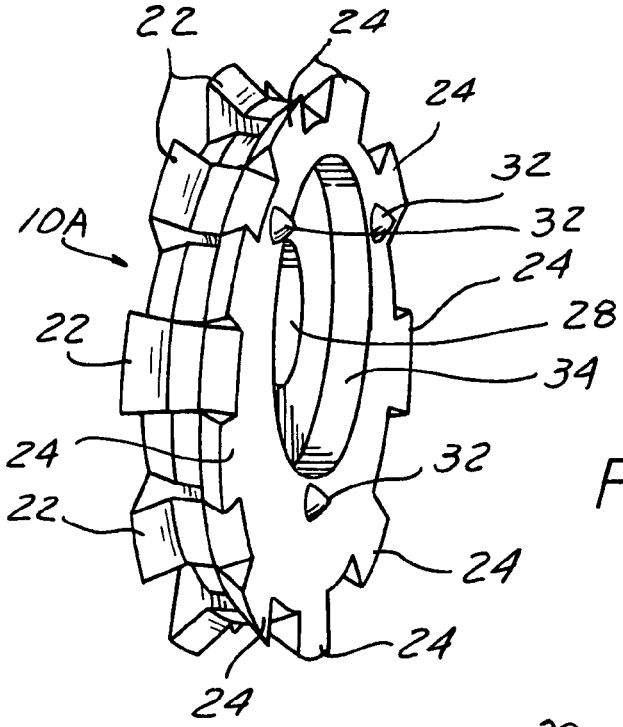
FIG. 5 is a pictorial view of a second embodiment of a mounting element according to the present invention.
Figure 6:
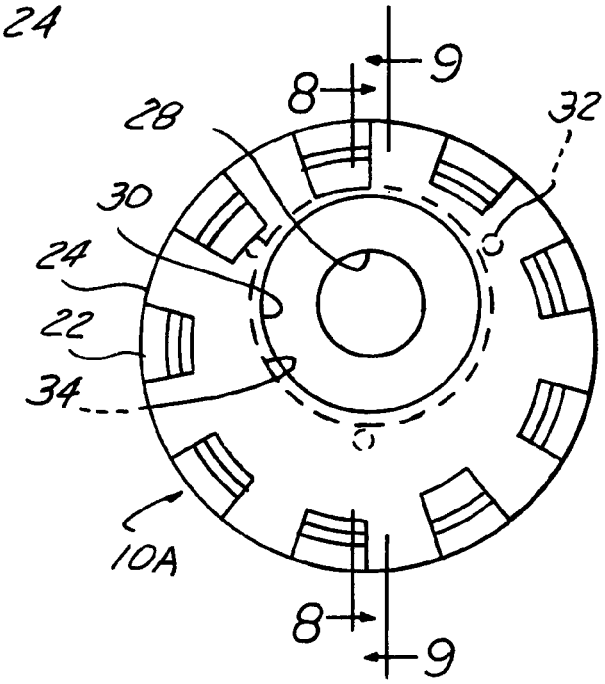
FIG. 6 is a front view of the mounting element shown in FIG. 5.
Figure 7:
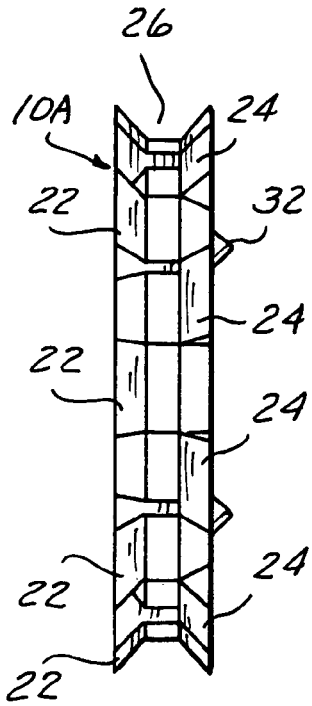
FIG. 7 is a side view of the mounting element shown in FIGS. 5 and 6.
Figure 8:
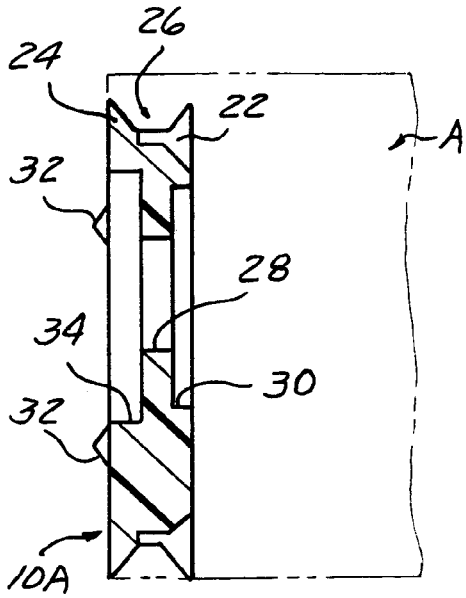
FIG. 8 is a view of the section 8-8 taken in FIG. 6.
Figure 9:
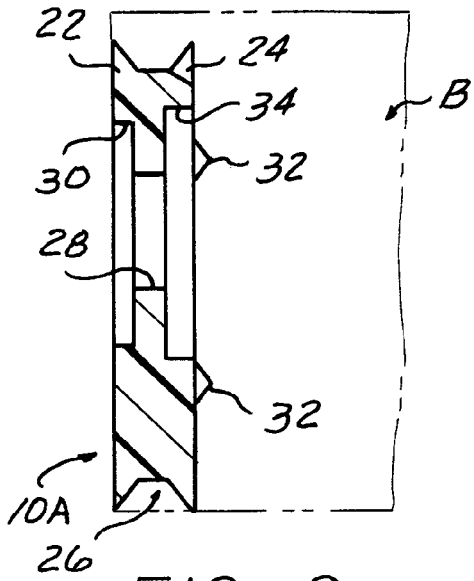
FIG. 9 is a view of the section 9-9 taken in FIG. 6.

As seen in FIGS. 4A-4C, the topmost part of the element 10 and groove 12 shifts up and down within the range defined by the eccentricity of the location of the hole 14.

The top of the groove 12 provides an engagement feature for a support such as a wire 20 or saw tooth hanger 36, attached to a wall hanging (not shown).

Thus, an infinite vertical adjustment can be provided of the topmost portion of the element 10 to enable adjustment of the height of support of the wall hanging.

Upon tightening of the fastener 16, sufficient friction is developed to maintain the element 10 in any adjusted position.

The element 10 should preferably be initially positioned in the nine o'clock position of FIG. 4B to allow up or down adjustment as necessary.

FIGS. 5-11B illustrate a second embodiment, in which the mounting element 10A comprises a toothed disc in which two circumferential series of offset outwardly flared teeth 22, 24 are separated by a stepped depth annular space 26.

The space adjacent teeth 22, 24 are at different radial depths, to create the stepped depth configuration of the space 26. The space 26 could also be a simple V groove as described above.

A hole 28 extends through the element 10A at a location eccentric to the center of the generally circular perimeter thereof. A first counterbore 30 is located on a side adjacent wall engaging protrusions 32 and a second counterbore 34 on the opposite side.

The complementary toothed shape allows injection molding of the element 10A without slides, since tools A and B (FIGS. 8 and 9) can be drawn straight apart after molding.

This creates the annular space 26.

The stepped depth annular space 26 is advantageous in that a saw toothed support 36 (FIGS. 11A, 11B) can engage one of the shoulders defining the stepped depth. At same time, a wire could also be used with a simple V shape groove.

Counterbore 34 accommodates the protruding portion of a MOLLY™ or other type wall board anchor 38, while counterbore 30 at least partially recesses the head of a threaded fastener 40 threaded into the anchor 38.

Figure 11A:
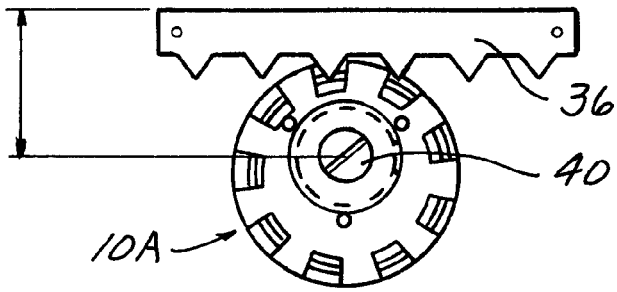
FIGS. 11A and 11B are front views of the mounting element shown in FIGS. 5-10 in two adjusted positions with respect to a saw tooth support piece shown which would be attached to the wall hanging.
Figure 11B:
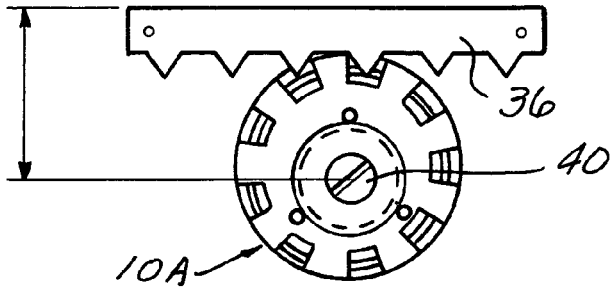

FIGS. 11A, 11B show the range of vertical adjustment available by rotation of the element 10A about the fastener 40.

Thus, a simple to use, low cost adjustable mounting has been provided.

The invention claimed is:

1. An adjustable mounting for hanging an object on a wall a generally disc shaped mounting element having an eccentrically located hole extending therethrough, the disc also having a perimeter and a back surface that engages a front surface of the wall such that the mounting element and the front surface of the wall may exert frictional forces therebetween in a plane that is parallel to the front surface;

a threaded fastener passing through the hole in said mounting element and into said wall and adapted to be secured by said wall and tightened against said mounting element to press said mounting element against the front surface of said wall to a selective degree to create a sufficient frictional force between said surface of said wall and said mounting element to prevent rotation of said mounting element about said fastener or to be loosened to allow rotation of said mounting element on said fastener; and an engagement zone on said mounting element perimeter engaged with a hanging support attached to said object, said zone being located eccentrically with respect to said hole, the zone being vertically displaced when said mounting element is rotated about said fastener so as to position said object to a desired location on said wall, said mounting element thereafter able to be frictionally held against said wall surface in said desired location, so that an operator may adjust the object's vertical position from a front surface of the wall without recourse to a back surface thereof;

wherein the engagement zone comprises a groove that is defined by two series of teeth arranged about said perimeter lying on either side of said mounting element; and further including protrusions on the back surface of the mounting element to prevent slippage out of an adjusted position.

2. The mounting according to claim 1 wherein each of said series of teeth are flared outwardly away from each other to define said groove.

3. The mounting according to claim 2 wherein said teeth in each series are offset from each other.

4. The mounting according to claim 3 wherein a surface extends between each of said series of teeth, defining the bottom of said groove.

5. The mounting according to claim 4 wherein said groove surface is stepped, being further out radially adjacent one set of teeth relative to the second set of teeth.

6. An adjustable mounting for hanging an object on a wall comprising:

a generally disc shaped mounting element having a perimeter and a generally back surface;

a fastener extending substantially normally to the back surface and passing through a hole located eccentrically in the mounting element and at least partially into the wall and being adapted for advancement into said wall and tightened against the mounting element to press the mounting element back surface against a front surface of the wall to a selective degree to create a sufficient frictional force between the surface of said wall and the back surface of the mounting element to prevent rotation of the mounting element about the fastener or to be selectively loosened to allow rotation of the mounting element on the fastener;

an engagement zone on the mounting element perimeter engaged with a hanging support attached to the object to be mounted thereon, the zone being located eccentrically with respect to the hole and so as to be shifted vertically when the mounting element is rotated about the fastener;

to thereby displace the engagement zone vertically and thus shift the object to a desired vertical position on the wall, the mounting element thereafter being able to be frictionally held against the wall surface in the desired vertical position by tightening of the threaded fastener against the mounting element to create the frictional force acting between the mounting element back surface and the wall surface;

wherein the engagement zone includes a groove that is defined by two series of teeth arranged about the perimeter lying on either side of the mounting element; and further including protrusions on the back surface of the mounting element to prevent slippage out of an adjusted position.

7. The mounting of claim 6, wherein each of the series of teeth are flared outwardly away from each other to define the groove.

8. The mounting of claim 7, wherein said teeth in each series are offset from each other.

9. The mounting of claim 8, wherein a surface extends between each of the series of teeth, defining the bottom of the groove.

10. The mounting of claim 9, wherein the groove surface is stepped, being further out radially adjacent one set of teeth relative to the second set of teeth.

11. An adjustable mounting for hanging an object on a wall comprising:

a generally disc shaped mounting element having an eccentrically located hole extending therethrough, the disc also having a perimeter and a back surface that engages a front surface of the wall such that the mounting element and the front surface of the wall may exert frictional forces therebetween in a plane that is parallel to the front surface;

a threaded fastener passing through the hole in said mounting element and into said wall and adapted to be secured by said wall and tightened against said mounting element to press said mounting element against the front surface of said wall to a selective degree to create a sufficient frictional force between said surface of said wall and said mounting element to prevent rotation of said mounting element about said fastener or to be loosened to allow rotation of said mounting element on said fastener;

an engagement zone on said mounting element perimeter engaged with a hanging support attached to said object, said zone being located eccentrically with respect to said hole, the zone being vertically displaced when said mounting element is rotated about said fastener so as to position said object to a desired location on said wall, said mounting element thereafter able to be frictionally held against said wall surface in said desired location, so that an operator may adjust the object's vertical position solely from a front surface of the wall without recourse to a back surface thereof protrusions on the back surface of the mounting element to prevent slippage out of an adjusted position and wherein the engagement zone is defined by two series of teeth arranged about the perimeter lying on either side of the mounting element.

* * * * *

UNITED STATES PATENT AND TRADEMARK OFFICE

CERTIFICATE OF CORRECTION

PATENT NO. : 7,654,500 B1
APPLICATION NO. : 10/807506
DATED : February 2, 2010
INVENTOR(S) : Kevin Jump It is certified that error appears in the above-identified patent and that said Letters Patent is hereby corrected as shown below:

Column 6, Line 7, Claim 11:

After "surface thereof" insert -- further including --.

Signed and Sealed this

Sixteenth Day of March, 2010

David J. Kappos

David J. Kappos
*Director of the United States Patent and Trademark Office*